US008763614B2

(12) United States Patent
Soare

(10) Patent No.: US 8,763,614 B2
(45) Date of Patent: Jul. 1, 2014

(54) EYEBROW STENCIL HOLDER

(71) Applicant: Anastasia Soare, Beverly Hills, CA (US)

(72) Inventor: Anastasia Soare, Beverly Hills, CA (US)

( * ) Notice: Subject to any disclaimer, the term of this patent is extended or adjusted under 35 U.S.C. 154(b) by 0 days.

(21) Appl. No.: 13/692,768

(22) Filed: Dec. 3, 2012

(65) Prior Publication Data

US 2013/0098385 A1 Apr. 25, 2013

Related U.S. Application Data

(60) Division of application No. 13/118,344, filed on May 27, 2011, now Pat. No. 8,342,190, which is a division of application No. 12/012,007, filed on Jan. 29, 2008, now Pat. No. 8,015,981, which is a continuation-in-part of application No. 11/840,986, filed on Aug. 19, 2007, now abandoned.

(51) Int. Cl.
*A45D 24/34* (2006.01)
*A45D 40/30* (2006.01)

(52) U.S. Cl.
USPC ..... 132/213; 132/319

(58) Field of Classification Search
USPC ..... 132/200, 213, 216, 214
See application file for complete search history.

(56) References Cited

U.S. PATENT DOCUMENTS 1,566,661 A * 12/1925 Essig ..... 33/514

* cited by examiner

*Primary Examiner* — Rachel Steitz
(74) *Attorney, Agent, or Firm* — Allan Z. Litovsky; Greenberg Traurig, LLP

(57) ABSTRACT

A novel gauging device and associated stencils facilitate the shaping of eyebrows according to a Golden Ratio standard. The gauging device is adapted to be placed over a woman's face and maintained in a fixed position relative to her eyes and nose. A nosepiece and knobs are adjusted such that a lower end of a guide rod may be rotated about various points relative to the nose and held in predetermined angles relative to the nose and eyes, possibly supported magnetically on a lower track adjacent the nostrils and an upper track above the eyebrows. An eyebrow stencil is held in a desired position relative to the previously positioned guide rod, which facilitates convenient application and symmetrical shaping, preferably with frictional clamps for permitting the stencil to be shifted in place so that a particular portion of the stencil is properly aligned with the guide rod after the guide rod has been aligned with an appropriate Golden Ratio marking on the stencil. Each stencil may be provided with more than one set of such markings to accommodate not only different eyebrows of different sizes, but also to adjust the eyebrow's ideal Golden Ratio "High Point" to complement facial proportions (preferably represented by a single Facial Ratio Value or "FRV" that takes into account several different measured ratios) that deviate substantially from an ideal Golden Ratio. A slim tab between the upper and the lower edges of the stencil cut-out preferably provides a convenient reference mark for the "High Point" of the unadjusted cut-out.

2 Claims, 5 Drawing Sheets

EYEBROW STENCIL HOLDER

CROSS REFERENCE TO RELATED APPLICATIONS

This application is a divisional of application Ser. No. 13/118,344 filed May 27, 2011, which is a divisional of application Ser. No. 12/012,007 filed Jan. 29, 2008, which is a continuation-in-part of application Ser. No. 11/840,986 filed Aug. 19, 2007. Those prior applications are hereby incorporated by reference in their entirety.

BACKGROUND

1. Technical Field

The present invention relates to cosmetic devices and, more particularly, to eyebrow shaping techniques and related apparatus.

2. Exemplary Prior Art and its Limitations

The Golden Ratio is a proportion universally found in Nature, expressed in the arrangement of branches along the stems of plants, in the placement of the shell spirals in snails, and in the features of the human body. The Golden Ratio is usually denoted by the Greek letter $\phi$ ('phi'), and it expresses the relationship that the sum of two quantities is to the larger quantity as the larger is to the smaller (its numerical approximation is 1.618033989). Leonardo da Vinci and many other great artists have used the Golden Ratio in their works, as it is believed to result in proportions that are not only natural but also especially pleasing aesthetically. Hence, their idea of a "perfect" face would conform to the Golden Ratio $\phi$ in various proportions including:

- Head Height (Scalp-to-Chin) divided by Head Width (Temple-to-Temple);
- Horizontal distance between Outer-edges-of-Eyes divided by Length-of-Mouth;
- Horizontal distance between Center-of-Eyes divided by Width-of-Nose;
- Vertical distance from Hairline-to-Chin divided by Hairline-to-Nosetip; and
- Vertical distance from Eyeline-to-Lips divided by Eyeline-to-Nosetip.

Similarly, the inventor has determined that on a "perfect" face, the High Point ("HP") of the eyebrow arch between its Starting Point ("SP") adjacent the nose and its End Point ("EP") adjacent the temple would divide the eyebrow arch at precisely the Golden Ratio point between the SP and the EP (SP-to-HP divided by HP-to-EP=$\phi$). The inventor has also observed that when the SP is on an imaginary guide line running vertically through the middle of the respective nostril, the EP on a second imaginary guide line running from the outer edge of the nostril through the outside end of the eye and the HP is located on an intermediate imaginary guide line extending from the center of the nose through the iris at the center of a woman's eye, there is an optimal match between her eyebrows and her other facial features. Although such a placement of the HP will typically be at the Golden Ratio only for a "perfect" face, it will also result in an aesthetically pleasing adjustment to the Golden Ratio when the other facial proportions (and in particular the size and location of the eyes relative to the other facial features) are less than "perfect". In practice these imaginary guide lines exist in three dimensional space and are prone to parallax errors. Stencils are commercially available which are provided with eyebrow cut-outs divided at the Golden Ratio point that provide a limited number of aesthetically pleasing eyebrow shapes for use on many different faces; however because each stencil has a fixed size and shape of cut-out, for a significant number of women the corresponding SP, EP and HP positions on the stencil will not fall exactly on the above-described properly placed SP, EP and HP guide lines. Moreover, not all eyes are perfectly sized and positioned in accordance with the Golden Ratio proportions. Accordingly a skilled beautician will constantly reposition the stencil as she is tracing the stencil cut-out, such that the SP, EP, and HP of the stencil are close to the desired locations on her client's face as the respective portion of the stencil cut-out is being traced. Obviously a beautician of lesser skill will have not only difficulty in determining the proper SP, EP, and HP locations on the client's face, but will also have difficulty in maintaining a smooth curve as the stencil is being repositioned and in maintaining symmetry between the two eyebrows.

TECHNICAL OVERVIEW AND PREFERENCES

The present invention enables even a relatively unskilled beautician to quickly and accurately determine the shape of the eyebrows according to the Golden Ratio standard.

In accordance with one aspect of the invention, a gauging device is provided with a mask-like headband, a vertically adjustable nosepiece extending downwardly from the headband for supporting at least one horizontally relocatable pivotable knob at its lower end, and a guide rod extending upwardly from the pivotable knob and adapted to be rotated with the knob. The gauging device is adapted to be placed over a woman's face (who will typically be in a supine position on a comfortable recliner with the back of her head supported on a padded horizontal headrest) with the headband resting over the forehead, high enough to leave the eyebrows exposed, and with the nosepiece providing additional support to maintain the gauging device in a fixed position relative to the woman's face, possibly secured by optional earpieces and/or straps. In use, the nosepiece and knobs are positioned such that the operator may conveniently rotate the guide rod about a desired point relative to the client's nose. For example, when determining the SP, the knob may be positioned at the bottom of the nose at the middle of the respective nostril, but may be slid horizontally across the lower portion of the nosepiece to the outermost edge of the nostril for determining the EP and then slid horizontally to the center of the nose for determining the HP. Once the pivot axis has been thus positioned relative to the woman's nostril, the guide rod may then be rotated relative to the client's eye and nose to thereby establish the proper location of the SP, EP and/or HP on the respective eyebrow. For example, for the SP the guide rod is preferably vertical (i.e., parallel to the nose bridge), for the EP it is lined up with the outermost edge of the respective eye, and for the HP it passes directly over the center of the eye (i.e., through the pupil at the center of the iris).

In an exemplary embodiment, the adjustable nosepiece preferably has a generally inverted T-shaped configuration and includes a vertical nose length bar adapted to extend from the forehead to the tip of the nose, and a curved horizontal angle bracket made of a suitable ferrous material that is adapted to surround the lowermost portion of the nose and that provides a track for supporting at least one repositionable magnetic knob and associated rotatable guide rod.

Preferably, the gauging device is adapted to hold an eyebrow stencil in a desired position relative to the previously positioned guide rods, which facilitates convenient application and symmetrical shaping. In the disclosed exemplary embodiment, friction clamps are attached to each side and to the center of the headband in such a way that enables one or more selected eyebrow stencils to be easily mounted, positioned, repositioned (if necessary) and then dismounted. In particular, the use of frictional clamps permits the stencil to be shifted in place so that a particular portion of the stencil is properly aligned with the guide rod after the guide rod has been aligned with a corresponding portion of the eyebrow.

In accordance with another aspect of the invention, improved eyebrow stencils are provided with Golden Ratio markings. A graduated EP scale is preferably imprinted adjacent the nominal EP of the cut-out which provides a reference EP offset which is used to locate a corresponding HP Golden Ratio offset on a graduated HP scale adjacent the nominal HP, for example by positioning the SP of the stencil over the client's ideal SP, then reading an EP offset marking on the stencil that is aligned with the clients ideal EP and reflects the extent to which the stencil's EP is initially offset from the client's EP, and then finding a corresponding ideal HP offset marking adjacent the stencil's HP that reflects an ideal Golden Ratio HP for that EP offset. The result is an adjusted HP which is located at a true Golden Ratio between the client's SP and EP.

In a preferred embodiment hereinafter referred to as a Golden Ratio Stencil ("GRS"), more than one set of such Golden Ratio HP offset markings are provided, so that if it is determined that a particular client's face has facial proportions (preferably represented by a single Facial Ratio Value or "FRV" that takes into account several different measured ratios) that deviate substantially from an ideal Golden Ratio, an adjusted Golden Ratio HP can be selected that also takes into account the client's actual FRV. The markings may comprise readily identifiable colors, shapes, numbers, letters, or other symbols or sequences of symbols, and different sets of otherwise identical markings may be spatially separated into different rows each corresponding to a different set of facial proportions, such that for each distinctive EP offset marking, there may be a corresponding HP offset marking in each of several readily identifiable sets of HP offset markings, to thereby identify for each EP offset, not only an ideal Golden Ratio HP offset, but also several different adjusted Golden Ratio HP offsets each corresponding to a different set of facial proportions. In an alternative embodiment, rather than simply dividing the possible facial proportions into a few categories each associated with a different Golden Ratio offset scale, each such category is assigned a numerical value which identifies the sequential location of the adjusted HP offset relative to the ideal HP offset, in which case only the ideal HP offsets need be explicitly marked, and only one HP offset scale is marked on the stencil. For example, the EP offset markings could be the sequential numbers 2 through 9, and the different FRVs could be assigned integer values between −2 and +2 (a so-called Simplified FRV or "SFRV") with SFRV=0 representing a range of FRVs that are close to the ideal (i.e., within one half of a standard deviation, SFRV=−1 representing a range of FRVs centered about a standard deviation of −1, SFRV=−2 representing a range of FRVs centered about a standard deviation of −2, et cetera, whereby once the ideal Golden Ratio HP offset marking has been located on the stencil corresponding to the selected EP marking for that client, the adjusted Golden Ratio HP offset can be readily located that is displaced to the right or left of that ideal marking in a direction and by an amount corresponding to that client's SFRV.

In a presently preferred embodiment of Golden Ratio Stencil (GRS), the stencil is fabricated from a clear, soft, non-irritating plastic, with an arched cut-out in the middle that provides an opening for the shaping of the eyebrow. Since the two eyebrows are mirror images, the same cut-out can be turned over for use on the other eye. These GRS cut-outs preferably come in various shapes (such as Petite Arch, Slim High Arch, Medium Arch, or High Arch) and are accordingly marked, to thereby accommodate almost every particular type of eyebrow. A slim Golden Ratio tab forms a bridge between the upper and the lower edges of the cut-out, so as to prevent the stencil from losing its shape during make-up application. In addition, this tab could also function as a convenient reference mark for the unadjusted HP between the SP and the EP of the GRS cut-out.

DETAILED DESCRIPTION OF A PREFERRED EMBODIMENT AND CERTAIN EXEMPLARY ALTERNATIVES

Figure 1:
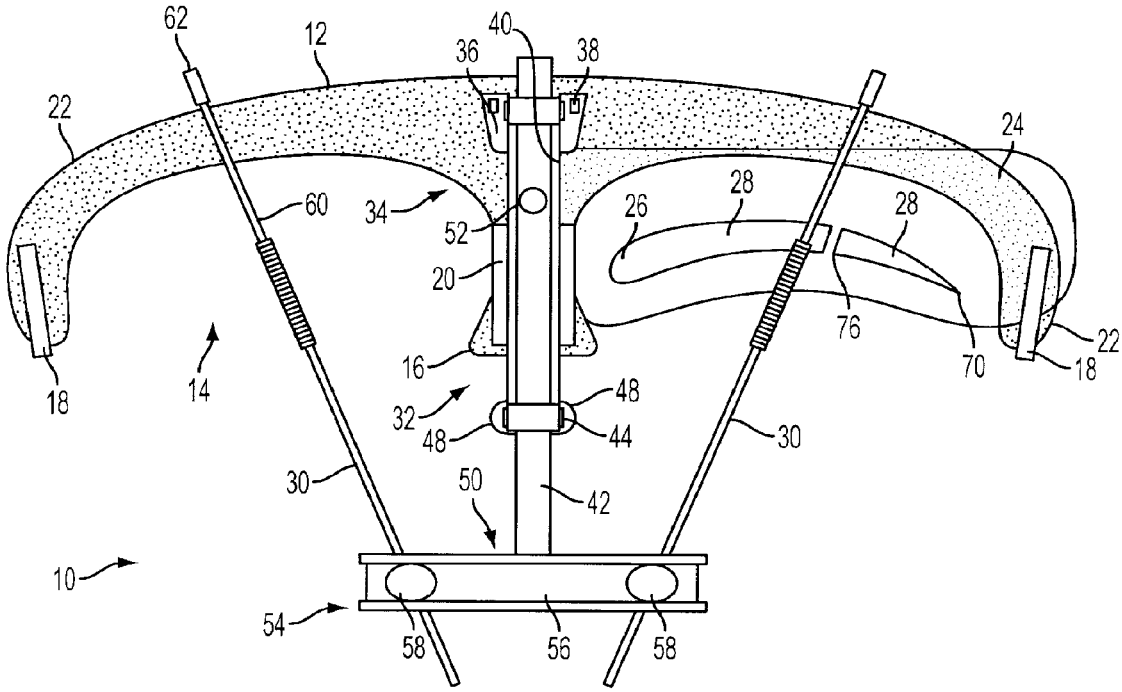
FIG. 1 is a schematic front view of an exemplary eyebrow gauging apparatus with a conventional eyebrow stencil clamped on one side.

Referring to the accompanying drawings, one preferred embodiment of a gauging device 10 for use with the present invention is depicted in FIG. 1. Device 10 is built around a shaped headband 12, made out of a flexible material such as leather, rubber, or silicone, that could be fitted around one's forehead much like a demi face mask, but with oval-shaped holes 14 that extend to the bottom of headband 12 and that expose not only the eyes but the entire orbital area including the eyelids and eyebrows. The headband 12 features an integrated vertical middle section 16, approximately 1-inch long, that is shaped to fit around one's nose and further secure the apparatus into place.

There are stencil clamps 18,20 attached to the headband 12, two side clamps 18 on the outer ends 22, and at least one center clamp 20 on the vertical middle section 16. When eyebrow stencils 24 are used, they are to be inserted (slid) through these clamps 18,20. The stencils can move in either direction (left-right, up-down) and they can be manually shifted and adjusted into an initial position where most of the eyebrow can be seen through the stencil cut-out. The stencils are then slightly repositioned into their ideal place where the inner edge 26 of the cut-out 28 is flush with the angle guide rod 30 in its SP position, according to the method described below. Preferably, two center clamps 20 are provided, on each side of the vertical headband section 16; alternatively, the width and placement of a single center clamp 20 relative to the headband 12 allows for two eyebrow stencils to be used at the same time. Although the same stencil 24 could be used successively on each side of the face, using two stencils and working on both eyebrows simultaneously facilitates a more symmetrical shaping and a more optimal application of make-up on both eyebrows.

Figure 2:
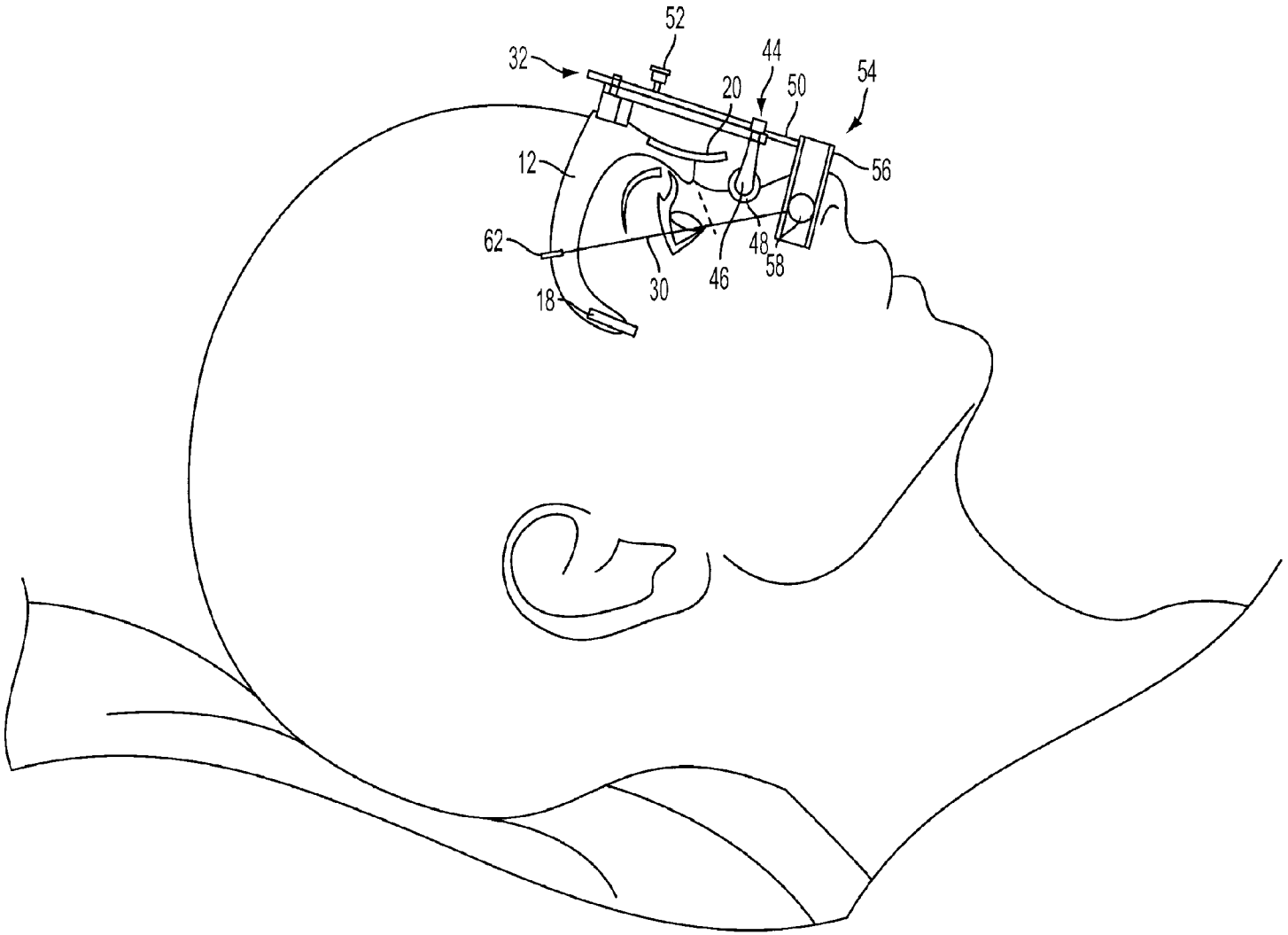
FIG. 2 is side view of the eyebrow gauging apparatus of FIG. 1 mounted on a client's head with a rotatable guide rod positioned over a key point on the client's eyebrow.

A nose bracket 32 is also attached to the headband 12. The nose bracket 32 runs alongside the nose and it comprises a top section 34, a fastening assembly 36, that is attached to the headband 12 with two small screws 38, a bracket 40 that runs parallel to the nose and allows the nose assembly bar 42 to slide through it, and a nose-holding block 44. As best seen in FIG. 2, the nose-holding block 44 consists of two small arched arms 46 attached on either side of the bottom of the metal bracket 40, with soft pads 48 on the ends. These pads come to rest on the nose and provide soft cushioning as the eyebrow gauging device 10 is secured safely to one's face.

A sliding assembly 50 in the shape of an inverted T is attached to the nose bracket top section 34 by means of a holding screw 52. This inverted-T assembly includes a nose-length bar 42 that is made to fit through the nose bracket 40 and is able to slide up and down to the position desired. The bottom portion 54 of the inverted-T sliding assembly 50 is attached to the nose-length bar 42 and comprises an angle bracket 56, two pivot knobs 58, and two angle guide rods 30. This sliding assembly is adjusted until the angle bracket 56 lines up with the bottom of the nose, and then it is fastened in place with the holding screw 52. The angle bracket 56 curves around the nose and it allows the adjustable pivot knobs 58 to slide along its curvature into the desired position around the nostrils. The angle guide rods 30 are in turn attached to the pivot knobs 58. In an exemplary embodiment, the curved horizontal angle bracket is made of a suitable ferrous material that provides a track for supporting at least one repositionable magnetic knob 58 and associated rotatable guide rod 30. The pivot knob 58 would rest at the middle of the nostril when determining the SP, at the edge of the nostril when determining the EP, or at the tip of the nose when determining the HP. The upper ends 60 of the angle guide rods 30 come to rest on the headband 12, and they have a soft rounded tip 62 to ensure safe handling. The angle guide rods 30 can move along perpendicular planes: they can be turned clockwise or counterclockwise by the angle knobs 58 along the facial planes, or they can move away and towards the face to facilitate easy gliding along the angle bracket 56. For example, for the SP the guide rod 30 is preferably vertical (i.e., parallel to the nose bridge), for the EP it may be lined up with the outermost edge of the respective eye, and for the HP it may pass directly over the center of the eye (i.e., through the pupil at the center of the iris). As shown in FIG. 2, the client is preferably in a supine position with gravity keeping gauging device 10 in position on the client's forehead and nose while the pivot knobs 58 and guide rods 60 are being manipulated. In other embodiments (not shown) a similar function can be provided by optional earpieces and/or ear straps which attach headband 12 to the client's ears, or by forming headband 12 from a more rigid material and extending the end portions 22 rearwardly and inwardly (possibly connected by an optional elastic band) such that headband 12 is pressed tightly against the client's temples.

Figure 3:
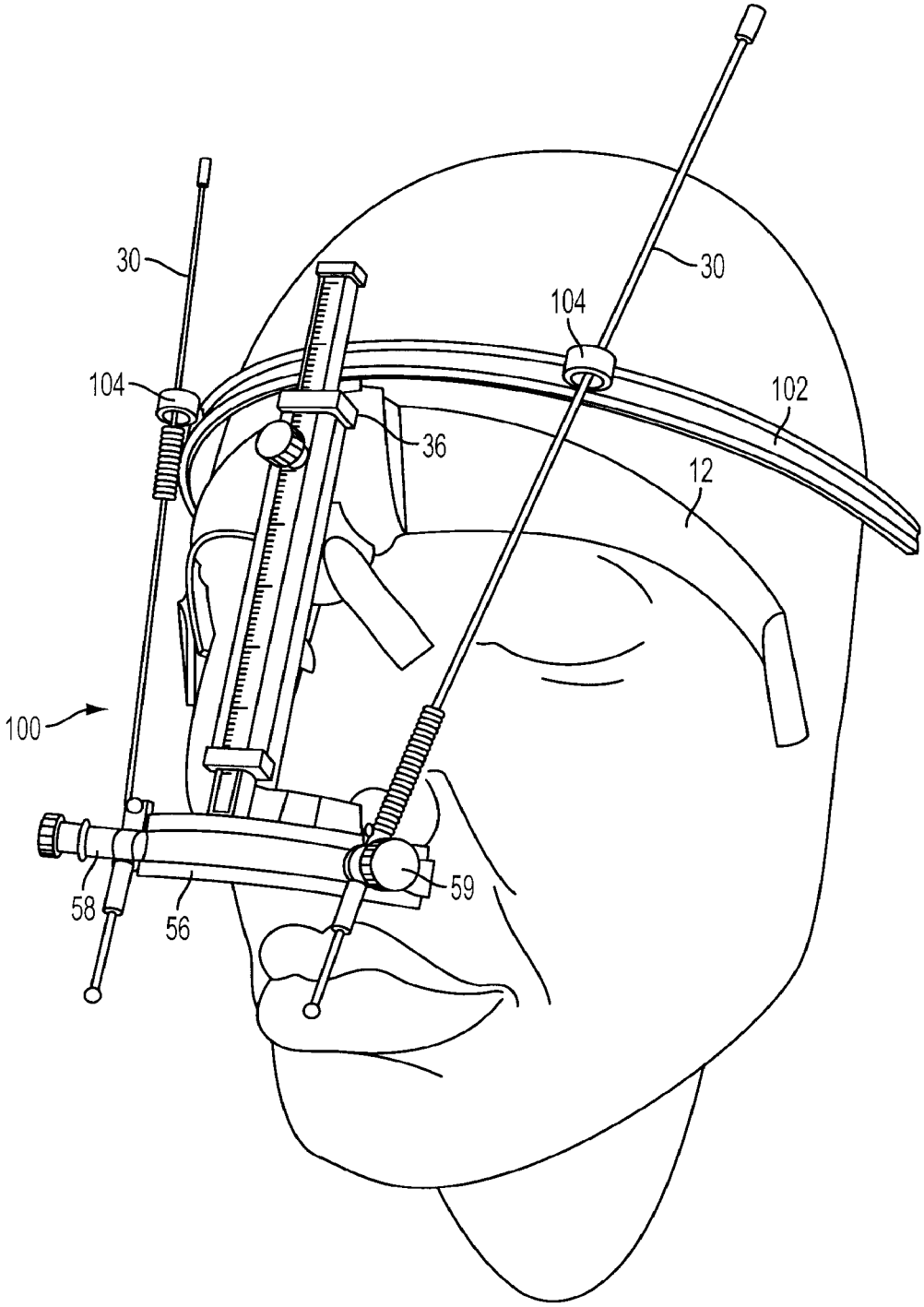
FIG. 3 is a three-quarter view of an alternative embodiment of the eyebrow gauging apparatus of FIG. 1, mounted on a client's head with the upper end of the rotatable guide rod magnetically supported on an upper track above the client's eyebrow.

FIG. 3 shows an alternative embodiment 100 of the eyebrow gauging apparatus 10 of FIG. 1 which further comprises an upper track 102 secured to headband 12 and nose bracket 36 such that track 102 extends across the client's forehead above the eyebrows. Each rotatable guide rod 30 passes through a respective magnetic bearing 104 which is magnetically repositioned on track 102 to thereby maintain the upper part of the rotatable guide rod 30 at its chosen location (SP, HP, or EP), which provides additional stability during use.

The Golden Ratio Stencils

Figure 4:
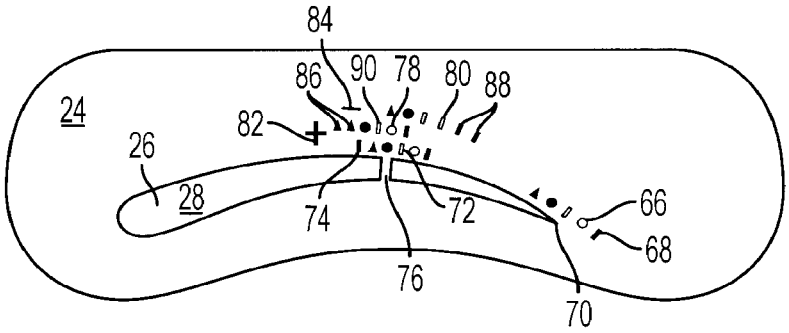
FIG. 4 is a plan view of an exemplary Medium Arch Golden Ratio Stencil that has been provided with a representative set of HP offset markings comprising multiple symbols and multiple groupings of such symbol, it being understood that the individual symbols and groupings of symbols have been selected for ease of comprehension and reproduction and that a preferred embodiment is not limited to the precise representations shown.

A preferred embodiment of an eyebrow stencil 24 adapted for use with the present invention is depicted in FIG. 4. It should be understood that the cut-outs 28 of the illustrated stencil are based on a stencil sold by Anastasia Beverly Hills under the designation "Medium Arch", but that numerous variations are possible, both to accommodate different facial types (for example, High Arch and Petite Arch) and to conform to current trends in fashion (for example, brows that are fuller or thinner than that illustrated). Moreover, the illustrated cut-outs are merely exemplary and the actual shape of cut-outs is not part of the present invention, it being preferable that a number of different stencils be available to accommodate the subjective preferences of the beautician and her client. In any event, even when more than one size and shape of stencil cut-out is available, it is to be expected that the client's eyebrow will not precisely cover the opening in the stencil, with some eyebrows being slightly longer than the cut-out, while others will be shorter. The SP is first determined by laying out an imaginary vertical line that runs through the middle of the respective nostril and finding the client's SP point where the vertical line intersects the eyebrow line, preferably using the gauging devices 10 of FIG. 1 or FIG. 2. The appropriate stencil (Petite Arch, High Arch, etc) is then applied over the eyebrow (by hand or with the use of a special stencil holder, such as the gauging device 10), with the blunt inner end 26 of the cut-out 28 aligned with the previously determined SP. Next, the ideal EP of the eyebrow is determined by laying out an imaginary line connecting the edge of the respective nostril and the outer edge of the respective eye. The EP is the point where this line intersects the eyebrow arch. The EP is visible under the clear stencil and it will fall on (or very close to) one of the symbols 66 on the graduated EP scale 68 marked alongside the upper edge of the GRS cut-out, near the tapered outer end 70. A matching symbol 72 of a graduated HP scale 74, also placed alongside the upper edge of the cut-out but closer to the Golden Ratio Tab 76, will determine the Golden Ratio HP. That is, on a "perfect" face, the thus selected HP will split the eyebrow arch at precisely the Golden Ratio point. Accordingly, after the portion of the stencil cut-out 28 adjacent to the SP has been used to shape the inner portion of the eyebrow, the stencil is then positioned with Golden Ratio Tab 76 aligned with the thus-selected HP, whereupon the middle portion of the eyebrow arch may be properly shaped, and then, with the stencil positioned with the tapered outer end 70 of the cut-out aligned with the previously identified EP (e.g., EP symbol 66), the outer portion of the eyebrow is appropriately shaped.

Each client's face is preferably assigned a numerical value for its proportions, to be known as the Facial Ratio Value ("FRV"), prior to applying the eyebrow stenciling method described above. This is determined by calculating four different values for the facial proportions (two horizontal, and two vertical) and then finding the mean value of these four numbers. The two horizontal factors are: Distance between Outer-edges-of-Eyes divided by Length-of-Mouth, and Distance between Center-of-Irises divided by Width-of-Nose. The two vertical factors are: Hairline-to-Chin divided by Hairline-to-Nosetip, and Eyeline-to-Lips divided by Eyeline-to-Nosetip. The mean for these four values is calculated using this formula:

$$\bar{x} = \frac{1}{N}\sum_{i=1}^{N} x_i = \frac{x_1 + x_2 \ldots + x_N}{N}$$

where $\bar{x}$ is the Facial Ratio Value, $x_i$ are the four values, and N=4.

On a "perfect" face all these values equal $\phi$ so naturally their mean would also be $\phi$. By measuring a random population sample of more than 300 subjects it has been determined that Facial Ratio Values vary from $\phi$ in most cases, but the mean value of all Facial Ratio Values combined is a very close approximation of $\phi$. This random sample of population is statistically expected to reflect the population at large, with a very narrow margin of error. This means that $\phi$ is the "expected value" for any randomly selected Facial Ratio Value, so the "standard deviation" of the random sample in relation to $\phi$ may be calculated by using the following formula:

$$\sigma = \sqrt{\frac{1}{N}\sum_{i=1}^{N}(x_i - \bar{x})^2}$$

where $\sigma$ is the standard deviation, $x_i$ are the Facial Ratio Values, $\bar{x}=\phi$, and N=300+

It has been found that a closely approximates 0.1, which means that any Facial Ratio Value between 1.518 and 1.718 would be within one standard deviation from the ideal $\phi$. Facial Ratio Values between 1.418 and 1.517, and between 1.719 and 1.818 would be within two standard deviations from $\phi$. According to Chebyshev's statistical formula, in a normally distributed population, it is to be expected that about 68% of the values (in this case Facial Ratio Values) would be within one standard deviation of the mean (in this case $\phi$), while about 95% of the population would be within two standard deviations.

A beautician may find it practical to assign a single Simplified Facial Ratio Value integer to each client, as these would be easy to remember (or filed for future reference) and one would only have to calculate a client's facial proportions just once. As such, a client would be assigned a Simplified Facial Ratio Value ("SFRV") from −2 to +2, as follows:

$SFRV = 0$ if the Facial Ratio Value ranges from 1.57 to $1.67(\varphi \pm \frac{\sigma}{2})$;

$SFRV =$ $-1$ if the Facial Ratio Value ranges from 1.47 to $1.56(\varphi - \sigma \pm \frac{\sigma}{2})$;

$SFRV =$ $+1$ if the Facial Ratio Value ranges from 1.68 to $1.77(\varphi + \sigma \pm \frac{\sigma}{2})$;

$SFRV =$ $-2$ if the Facial Ratio Value ranges from 1.37 to $1.46\varphi - 2\sigma \pm \frac{\sigma}{2})$;

$SFRV =$ $+2$ if the Facial Ratio Value ranges from 1.78 to $1.87(\varphi + 2\sigma \pm \frac{\sigma}{2})$.

There are two general cases to be considered. If it is determined by measurement that a face displays a close approximation of Golden Ratio proportions then the HP is determined as described above. If, however, the client's facial proportions deviate from $\phi$, it should be determined whether those proportions are substantially (by more than one half of a standard deviation) above or below the Golden Ratio (i.e., SFRV is not equal to zero). The SP and the EP are found on the eyebrow by following the method above. The HP is then determined on the GRS by corresponding symbols 78,80 on either of the two rows 82,84 of graduated markings (which use an expanded and a contracted version of the Golden Ratio to located the HP) which are preferably placed above and parallel to the previously described normal graduated HP scale 74.

The markings on these two additional upper rows are placed along imaginary arches on either side of the Golden Ratio Tab, and they mark one and two degrees of standard deviation one way or the other. For practical purposes the preferred embodiment of this present invention shows only a one standard deviation marking (e.g. white circle 78,80) for four out of the five reference points, and it shows both the one and two standard deviation markings for the outer reference points: the two black triangles 86 at the left end of row 82, and the two black rectangles 88 at the right end of row 84. Row 82 directly above normal graduated HP scale 74 the markings for the positive standard deviations, while the third graduated row 84 further above comprises markings associated with the negative standard deviations. In the illustrated embodiment, the spacing between adjacent EP reference symbols 68 is such that for a given HP, it corresponds to a 16 difference in the ratio between HP and EP. Thus, the HP offset is required for a face which has proportions that differ from "normal" by $2\sigma$ would be approximately the same as that for a face with 1 a proportions and an EP offset that is only one marking away.

Accordingly, it is not necessary to provide yet another set of graduated scales 82,84 for $2\sigma$ faces, the 1 $\sigma$ scales are also used for $2\sigma$ faces, but selecting an adjacent HP offset symbol, whereby the HP location for a $2\sigma$ face is offset by one additional mark. For example, if white circle 66 designates the EP on a $+2\sigma$ face, rather than selecting white circle 78 on the $+1\sigma$ scale 82, white rectangle 90 to its left is selected which results in an HP closer to the midpoint between the SP and EP and thus a higher ratio of EP to HP. In effect by adding only one more marking (at the positive end) the same scale 82 can accommodate both $+1\sigma$ and $+2\sigma$ faces.

Figure 5:
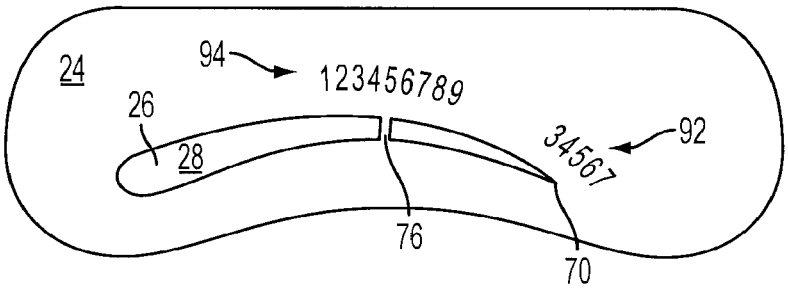
FIG. 5 is a plan view of an exemplary Medium Arch Golden Ratio Stencil that has been provided similar to that in FIG. 4, but with a representative set of HP offset markings comprising numerical symbols arranged in a single numerical sequence of such symbols, whereby knowledge of a SFRV or other similar HP offset integer for a particular client permits an adjusted HP offset to be readily located on the stencil relative to an ideal HP offset marking.

Similarly, as shown in FIG. 5, simply by replacing the symbolic EP and ideal HP offset scales 68,78 with numerical EP and HP offset scales 92,94 and adding two additional reference markings at each end of the numerical HP scale 92 (corresponding to the maximum and minimum $1\sigma$ and $2\sigma$ HP offsets) it would be possible to combine all three scales into a single scale. In that case, the ideal HP offset marking (e.g., number 4 on HP scale 94) corresponding to the client's EP offset marking (e.g., number 4 on EP scale 94) is selected as before and if the client's face is a $0\sigma$ it is used without any modification, but for a $-1\sigma$ face it is further offset towards the SP 26 (for example to number 3 on HP scale 94) and for $+1\sigma$ face it is further offset towards the EP 70 (for example to number 5 on HP scale 94). In either case, the space occupied by a single symbol preferably corresponds to a one sigma deviation, and the space occupied by two adjacent symbols preferably corresponds to a two sigma deviation. In the particular example illustrated, this is conveniently accomplished by simply summing the EP numerical offset and the SFRV to thereby determine the HP numerical offset.

Figure 6:
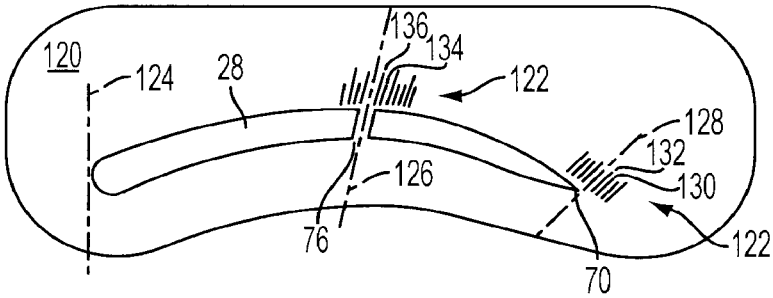
FIG. 6 is similar to FIG. 5 but shows an alternative embodiment in which the numerical markings are replaced with long and short index marks.

An alternative embodiment of a Golden Ratio Stencil is shown in FIG. 6. Although conceptually similar to the FIG. 4 and FIG. 5 embodiments, this modified stencil 120 uses a sequence 122 of alternating long and short index marks on either side of a nominal HP or EP, with the nominal SP, HP, and EP each being indicated with a respective vector 124, 126, 128 that indicates the corresponding orientation of the angle guide rod 30. As was true for the numerical scales of FIG. 5, the EP offset is noted (for example the first short index mark 130 to the right of the first long index mark 132 to the right of the EP vector 128) and a corresponding offset for the HP (the first short mark 134 to the right of the first long mark 136 to the right of the HP vector 126) is then found on HP scale 122. Again, adjustments to accommodate an SFRV other than zero can be made by selecting an HP offset that is displaced from the nominal offset by a corresponding number of index positions.

Since the illustrated embodiments of a Golden Ratio Stencil have markings that will accommodate FRVs that deviate from normal by at least two standard deviations, it will provide accurate guidelines for almost the entire population.

Various other alterations, modifications, and additions can be made to the present invention, with respect to the number, function and shape of the individual parts and/or the choice of materials, including but not limited to the number of the markings, placement, colors and symbols used, stencil design, size and shape of stencil cut-outs. All such variations that are within the scope of the appended claims, whether or not incorporated in the described examples, form part of the present invention.

The invention claimed is:

1. An eyebrow stencil holder for supporting an eyebrow stencil with respect to a Starting Point ("SP") on a first imaginary line running vertically through a respective nostril, an End Point ("EP") on a second imaginary line connecting the nostril to the outer edge of a respective eye, and a High Point ("HP") on a third imaginary line between the first and second imaginary lines, said holder comprising:

a mask-like headband adapted for placement on the forehead above the eyebrows;

an adjustable nosepiece extending downwardly from the headband including an angle bracket that is adapted to be positioned adjacent to the nostrils;

at least one angle guide rod slidably and rotatably attached to the angle bracket whereby the angle guide rod can be successively positioned along said first, second and third imaginary lines, to thereby locate said SP, EP and HP; and at least one frictional clamp attached to the headband for slidably and retractably supporting the eyebrow stencil in front of a respective eyebrow whereby a cut-out in the stencil can be positioned in different predetermined relationships with said SP, EP and HP.

2. The eyebrow stencil holder of claim 1, wherein:

the angle guide rod further comprises a magnetic knob;

the angle bracket is curved and made of a ferrous material that provides a track for slidably and rotatably supporting the magnetic knob; and the adjustable nosepiece further comprises a vertical nose length bar adapted to extend from the forehead to the tip of the nose with the angle bracket extending across the lower end of the nose length bar and curving around the nose.

* * * * *